US005382969A

United States Patent [19]

Mochizuki et al.

[11] Patent Number: 5,382,969

[45] Date of Patent: Jan. 17, 1995

[54] INK-EXPELLING RESTORING DEVICE AND METHOD FOR INK JET PRINTER

[75] Inventors: Seiji Mochizuki; Hitoshi Hayakawa; Kazuhisa Kawakami, all of Nagano, Japan

[73] Assignee: Seiko Epson Corporation, Tokyo, Japan

[21] Appl. No.: 991,541

[22] Filed: Dec. 15, 1992

[30] Foreign Application Priority Data

Dec. 24, 1991 [JP] Japan ..... 3-356243

[51] Int. Cl.[6] ..... B41J 2/165

[52] U.S. Cl. ..... 347/23; 347/28; 347/30; 347/33

[58] Field of Search ..... 346/1.1, 140 R; 347/7, 347/19, 23, 28, 30, 33, 36

[56] References Cited

U.S. PATENT DOCUMENTS

| | | | |
|---|---|---|---|
| 4,546,363 | 10/1985 | Iwagami | 346/140 R |
| 4,701,771 | 10/1987 | Ikeda | 346/140 R |
| 4,926,196 | 5/1990 | Mizoguchi et al. | 346/140 R |
| 4,965,596 | 10/1990 | Nagoshi et al. | 346/140 R |
| 5,202,702 | 4/1993 | Terasawa et al. | 346/1.1 |

FOREIGN PATENT DOCUMENTS

| | | | |
|---|---|---|---|
| 0443245 | 8/1991 | European Pat. Off. . | |
| 0480473 | 4/1992 | European Pat. Off. . | |
| 60-002369 | 1/1985 | Japan | 346/140 R |

*Primary Examiner*—Benjamin R. Fuller
*Assistant Examiner*—J. Barlow
*Attorney, Agent, or Firm*—Sughrue, Mion, Zinn, Macpeak & Seas

[57] ABSTRACT

An ink expelling restoring device and method capable of reliably restoring the ink-expelling restoring capability of an ink jet type recording head and coping with the case where the ink supply is exhausted during the ink-expelling restoring process. The inventive ink-expelling restoring device for an ink jet printer includes a capping member for capping the front face of a recording head, an ink-residual quantity detector for checking the residual quantity of ink, and blade member for wiping the front face of the recording head. The ink expelling capability restoring operation is carried out by a sequence of a wiping operation, ink-suction operation, and flushing operation. The residual-quantity detector checks the residual quantity of ink during the operation of restoring the ink-expelling capability. When the residual quantity of ink is smaller than a preset quantity, the ink suction operation is stopped. The recording head is capped with the capping member after the flushing and wiping operations. With such a construction, when a small quantity of ink is left in the ink container during the ink-expelling restoring process, the ink suction is stopped, preventing useless consumption of ink.

9 Claims, 7 Drawing Sheets

INK-EXPELLING RESTORING DEVICE AND METHOD FOR INK JET PRINTER

BACKGROUND OF THE INVENTION

The present invention relates to an ink-expelling restoring device and method for restoring, when ink-expelling failure occurs, the ink-expelling capability of an ink jet printer of the type in which a pressure generating device applies pressure to the ink in an ink chamber to discharge a stream of ink droplets through the opening of a nozzle from the ink chamber.

In an ink jet printer, a piezoelectric element and a bubble generating device, which are located between an ink tank and the opening of a nozzle, apply a pressure pulse to the ink in the ink tank to expelling a stream of ink droplets toward a recording media, thereby recording dots on the recording medium. The diameter of the nozzle opening is extremely small, e.g., several tens of microns, so as to obtain a good resolution of an image recorded with patterns of such dots. However, if dust, ink residue, etc., sticks to the nozzle opening, the picture quality is remarkably deteriorated.

To avoid the deterioration of the picture quality, the conventional printer has an ink-expelling capability restoring function. In the ink-expelling restoring process, after continuous printing has been carried out for a certain period of time, the printing operation is brought to a stop and a capping member is applied to the front face of the recording head to apply a negative pressure thereto and to forcibly discharge the ink therefrom.

To ensure complete cleaning of the recording head, the restoring operation is performed in combination with both a wiping operation and a flushing operation. The wiping operation is employed to wipe dust from the front face of the recording head by rubbing with a resilient plate piece. The flushing operation is to flush the nozzle with ink for restoring the meniscus that was destroyed by the wiping operation.

When the ink in the ink tank is used up during the ink-expelling restoring operation, bubbles tend to enter the ink supply path and the recording head. Also, ink in the ink supply path can solidify, making it difficult to remove the ink therefrom.

SUMMARY OF THE INVENTION

Taking the above problems into account, the present invention has as an object the provision of a novel ink-expelling restoring device and method free from the problems which occur when the ink supply is entirely consumed during the ink-expelling restoring operation.

To achieve the above and other objects of the invention, there is provided an ink-expelling restoring device for an ink jet printer comprising a capping member for capping the front face of a recording head, an ink-residual quantity detector for checking a residual quantity of ink in an ink container, a wiping device for physically wiping the front face of the recording head, and a control device for restoring the ink-expelling capability by a sequence of a wiping operation, an ink-suction operation, and a flushing operation, checking the residual quantity of ink by the ink-residual quantity detector during the operation of restoring the ink-expelling capability, and stopping the ink suction operation when the residual quantity of ink is smaller than a preset quantity of ink, while at the same time capping the recording head with the capping member after the flushing and wiping operations.

With such a construction, during the ink-expelling restoring operation, when the residual quantity of ink in the ink container is smaller than a predetermined quantity of ink, the ink suction operation is brought to a stop. Then, the wiping operation and the flushing operation, and finally the capping operation are carried out. Therefore, there is no further consumption of ink, and the recording head is ready for a new ink supply in a state wherein the ink has been expelled from the recording head by the ink suction operation.

As a consequence, the recording head stands ready for another recording operation while ink is left in the ink supply path and the recording head, and the opening of the nozzle is maintained in a normal state.

BRIEF DESCRIPTION OF THE DRAWINGS

FIG. 4(*b*) is a perspective view showing an idle roller drive section;

DESCRIPTION OF THE PREFERRED EMBODIMENTS

The preferred embodiments of the present invention will be described in detail with reference to the accompanying drawings.

Figure 2:
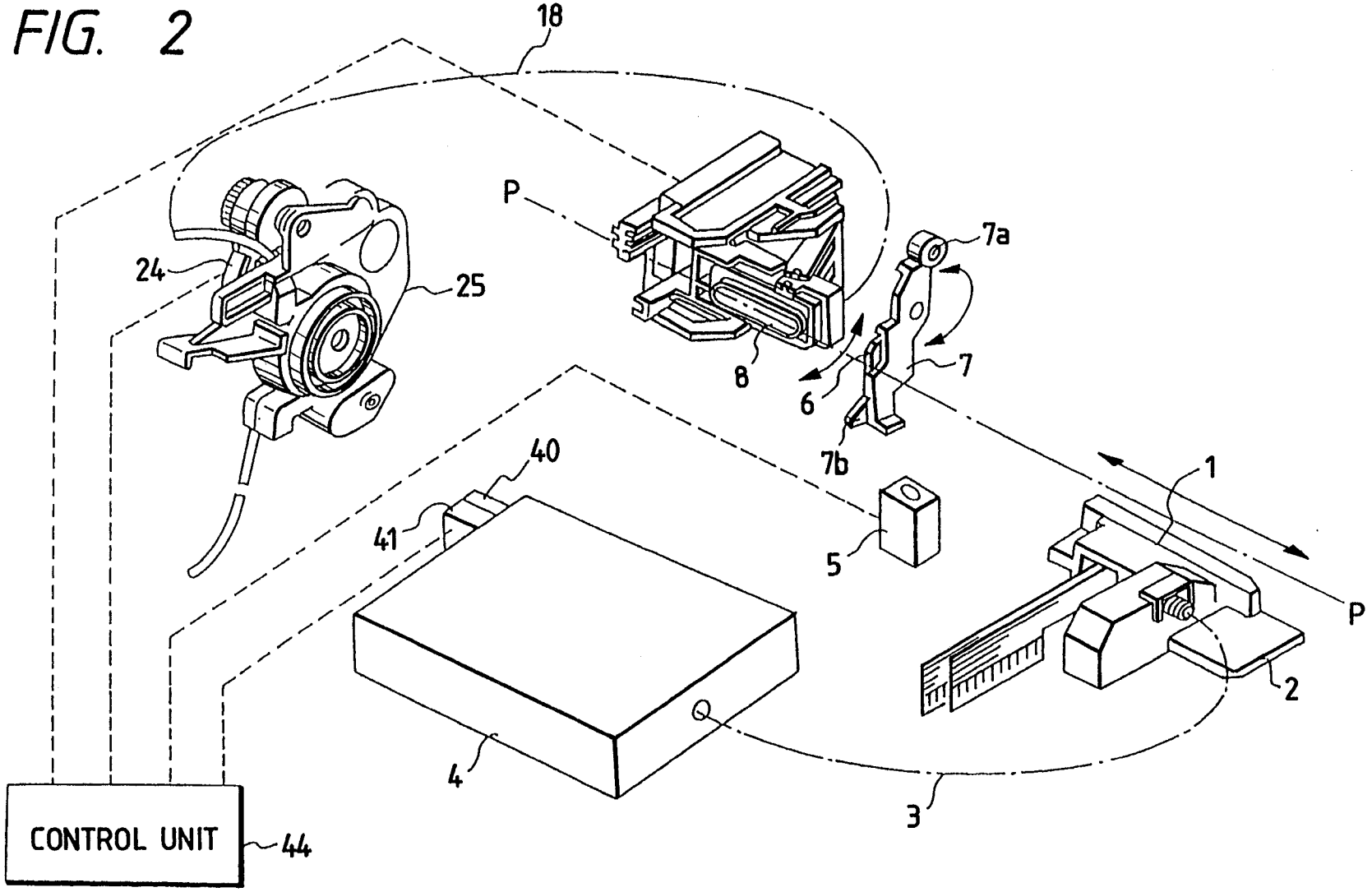
FIG. 2 is an exploded view in perspective of a mechanism used for an ink-expelling restoring operation in an ink jet printer to which the present invention is applied.

FIG. 2 is an exploded view in perspective of a mechanism used for carrying out an ink-expelling restoring operation in an ink jet printer to which the present invention is applied. In the figure, an ink jet recording head 1 is constructed such that ink droplets are forcibly discharged from the opening of nozzle by applying data signals representative of characters or other information to be recorded to piezoelectric elements or heat-generating elements. The recording head 1 is mounted on a carriage 2, which is movable along a path P—P coincident with a platen roller shaft. The recording head 1 is coupled with an ink cartridge 4 by way of a tube 3, and receives ink from the ink carriage 4.

A home position detector 5, located outside but in the vicinity of the printing region, produces a signal when the carriage 2 is at the home position. A blade member 6 and a capping member 8 are mounted in this order at locations which are further outside the printing region (on the left side in the drawing) than the home position detector 5 and are spaced by fixed distances from the home position.

The blade member 6, which includes a resilient plate made of rubber, for example, is rotatably mounted on the base of a shaft 7*a*. The blade member 6 is fastened to an arm 7, which is connected to a motor 24 for driving a pump 25 (to be described later) by means of a transmission mechanism (not shown). In the wiping mode, the blade member moves toward the recording head and resiliently contacts the nozzle face of the recording head.

Figure 3:
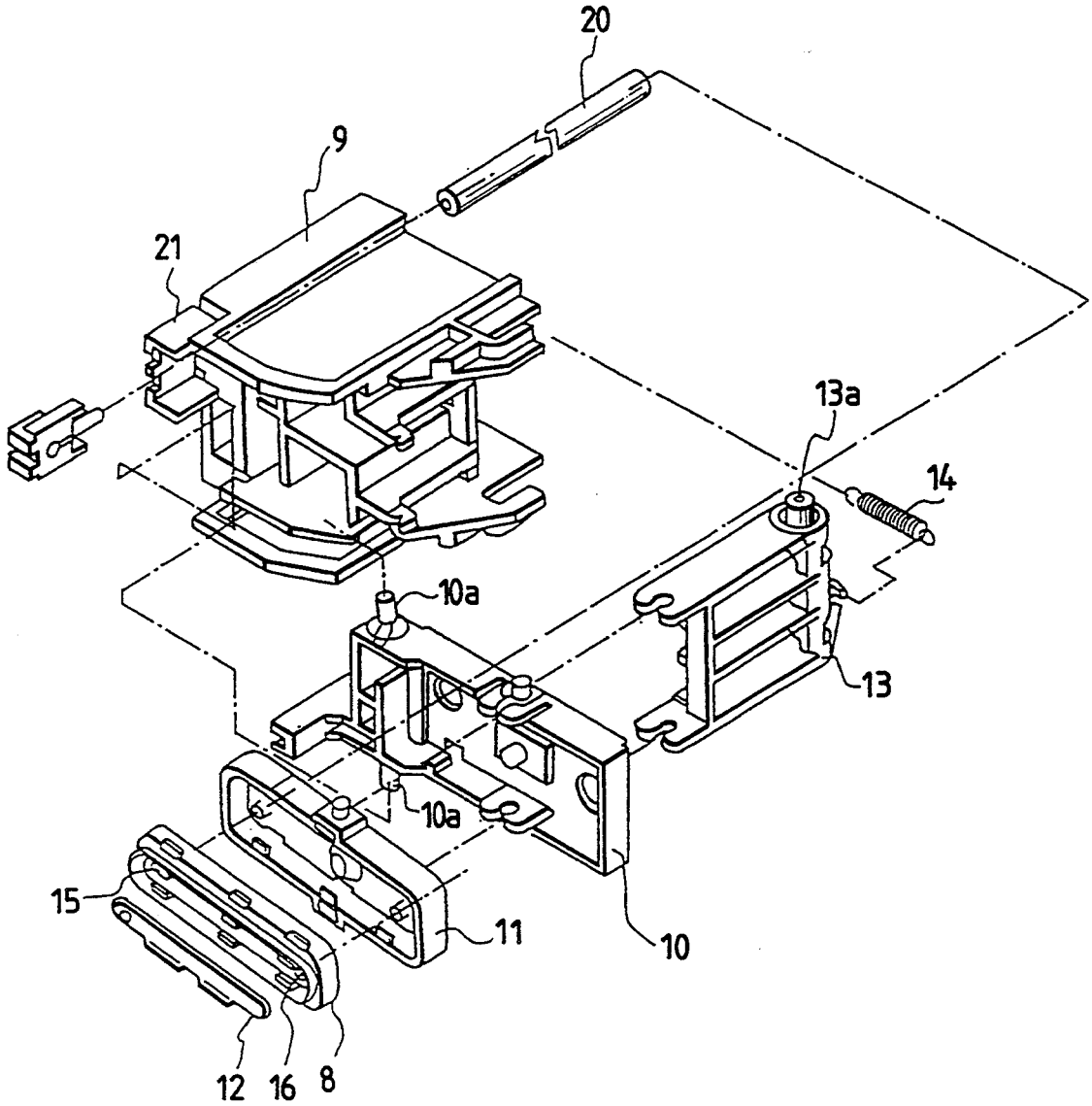
FIG. 3 is an exploded view in perspective of a capping member used by the ink-expelling restoring device of the invention.

As shown in FIG. 3, the capping member 8 is mounted on a frame 10 in a such a manner that the middle frame 11 is interposed therebetween. The frame 10 is rotatably coupled with a base member 9 by means of shafts 10*a* and 10*a*. The capping member 8 contains therein an ink absorbing member 12 of a size large enough to provide a fixed space between the capping member and the nozzle opening. A lever 13 is rotatably coupled at its base end with the base member 9 by means of a shaft 13*a*, and is coupled at its forward end with the free end of the frame 10. The lever 13 is normally urged by a spring 14 so as to pull the capping member 8 away from the path of movement of the recording head.

The capping member 8 has two holes 15 and 16. The hole 15 is connected to a suction port of a suction pump (to be described later) through a tube 18. The hole 16, connected to a valve 21 through a tube 20, selectively communicates with the outside atmosphere via the valve 21.

Figure 4B:
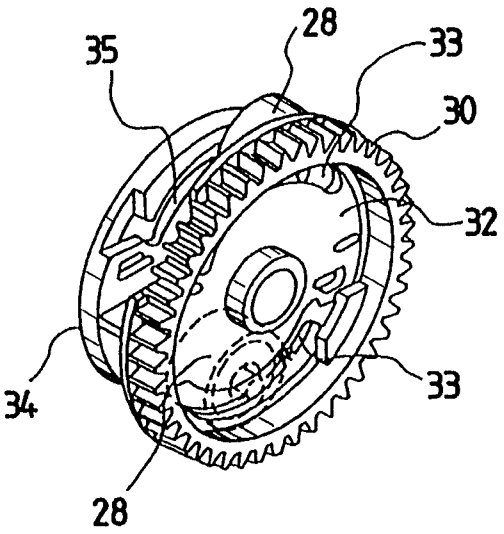
FIG. 4(*a*) is a partial cross sectional view showing a pump used by the inventive ink-expelling restoring device.
Figure 4A:
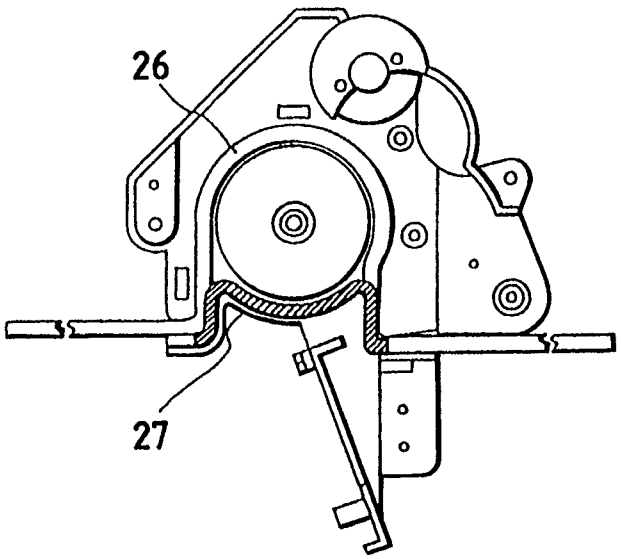

As shown in FIGS. 4(*a*) and 4(*b*), a peristaltic-type suction pump 25 includes an elastic tube 26 arcuately shaped by a frame, with the outer peripheral side thereof fixed to a guide member 27. The inner peripheral side of the tube 26 is squeezed by a plural number of rollers 28 and 28. The rollers 28 and 28 for squeezing the elastic tube 26 are inserted into elongated grooves 33 formed in a drive disk 32, which is connected through a transmission mechanism 30 to the motor 24, and guide grooves formed in a fixed disk 34. The drive disk 32 is disposed opposed to the fixed disk 34. Each of the grooves 33 is shaped so that the distance from the groove to the center of the disk gradually changes. The guide grooves 35 are shaped similar to the elongated grooves 33. With such a structure, when the motor 24 turns counterclockwise (CCW), the shafts of the rollers 28, which are fixed at positions spaced apart from the center of the drive disk 32, intermittently contact the elastic tube 26. When the motor 24 turns clockwise (CW), the rollers 28 move toward the center of the drive disk 32 to disengage from the elastic tube 26.

An ink-cartridge detector 40 and an ink residual-quantity detector 41 are located near the ink cartridge 4. The ink-cartridge detector 40 detects whether or not an ink cartridge 4 is loaded. The ink residual-quantity detector 41 detects the residual quantity of ink in the cartridge.

A control unit 44, mainly implemented with a microcomputer, receives outputs from the home position detector 5, ink-cartridge detector 40 and ink residual-quantity detector 41. The control unit 44 is programmed so as to control, in accordance with the received signals, various operations of the ink-expelling restoration process so as to wipe the recording head 1 and suck ink by a negative pressure applied from the pump 25 when the capping member 8 is brought into resilient contact with the nozzle face of the recording head.

Figure 1:
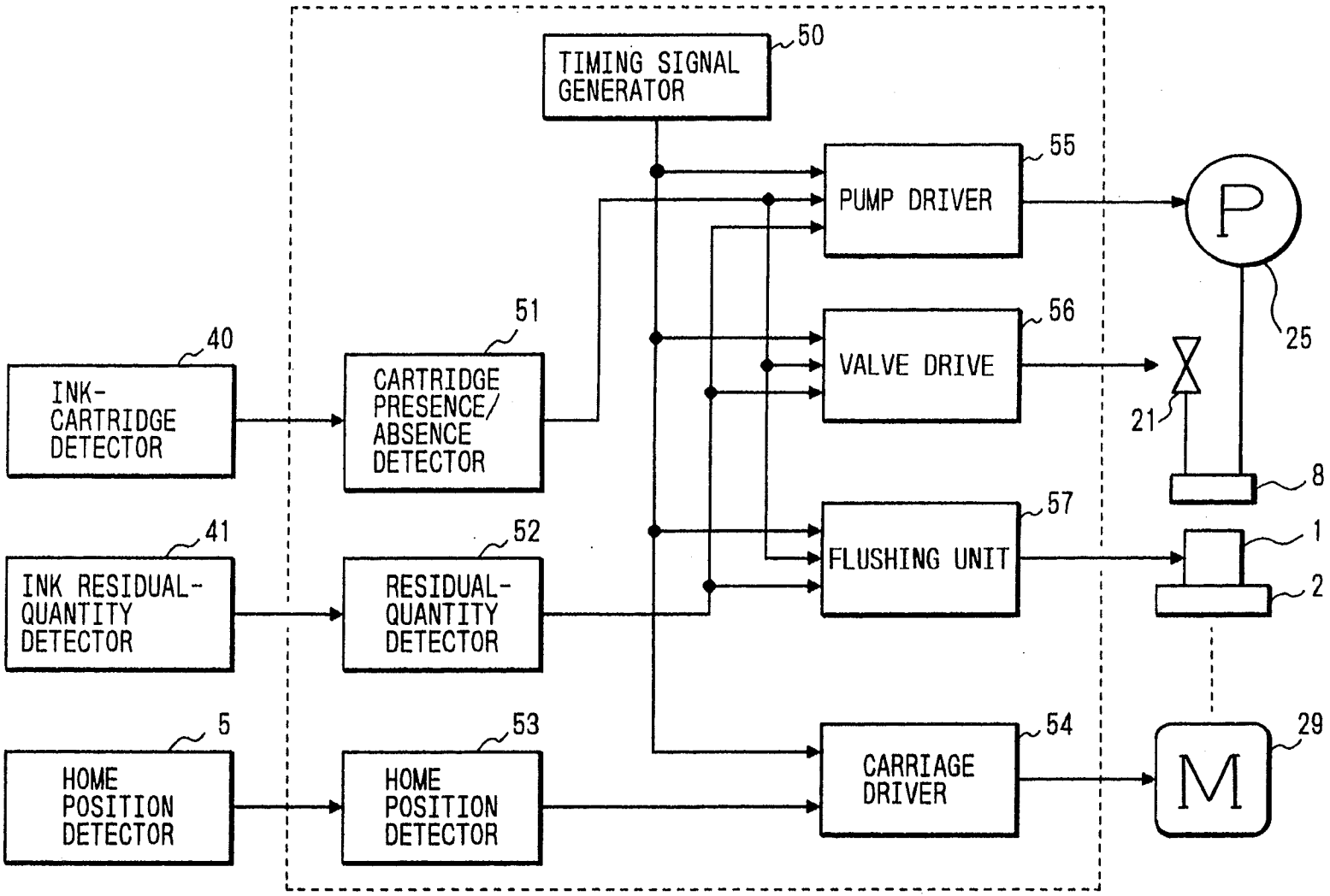
FIG. 1 is a block diagram showing the functions implemented with a microcomputer for controlling an ink-expelling restoring process.

FIG. 1 is a block diagram showing the functions carried out by the microcomputer 44 acting as the control unit. The microcomputer is programmed so as to realize, by appropriate software and hardware techniques, the functions of a timing signal generator 50, cartridge presence/absence detector 51, residual-quantity detector 52, home position detector 53, carriage driver 54, pump driver 55, valve driver 56, and flushing unit 57.

The timing signal generator 50 generates timing signals to determine the period of the ink-expelling restoring operation, the timing for moving the carriage, the timing for flushing, the timing for opening and closing the valve, and the timing for driving the pump. The cartridge presence/absence detector 51 determines whether an ink cartridge 4 is loaded or not by a signal from the ink-cartridge detector 40. The residual-quantity detector 52 detects the residual quantity of ink by a signal from the ink residual quantity detector 41. The home position detector 53 detects the arrival of the carriage 2 at the home position by a signal from the home position detector 5. The carriage motor drive unit 29 moves the carriage from the home position to the blade member 6. The recording head 1 is moved to the position of the blade member 6, the capping position, and the flushing position in sequence by operation of a motor drive unit 29. The pump driver 55 operates the pump 25 when the recording head I is capped. The valve driver 56 opens the valve 21 to suck excess ink within the capping member 8 when the recording head 1 is capped. The flushing unit 57 drives the recording head 1 for idle expelling when the recording head reaches the flushing position.

Figure 5:
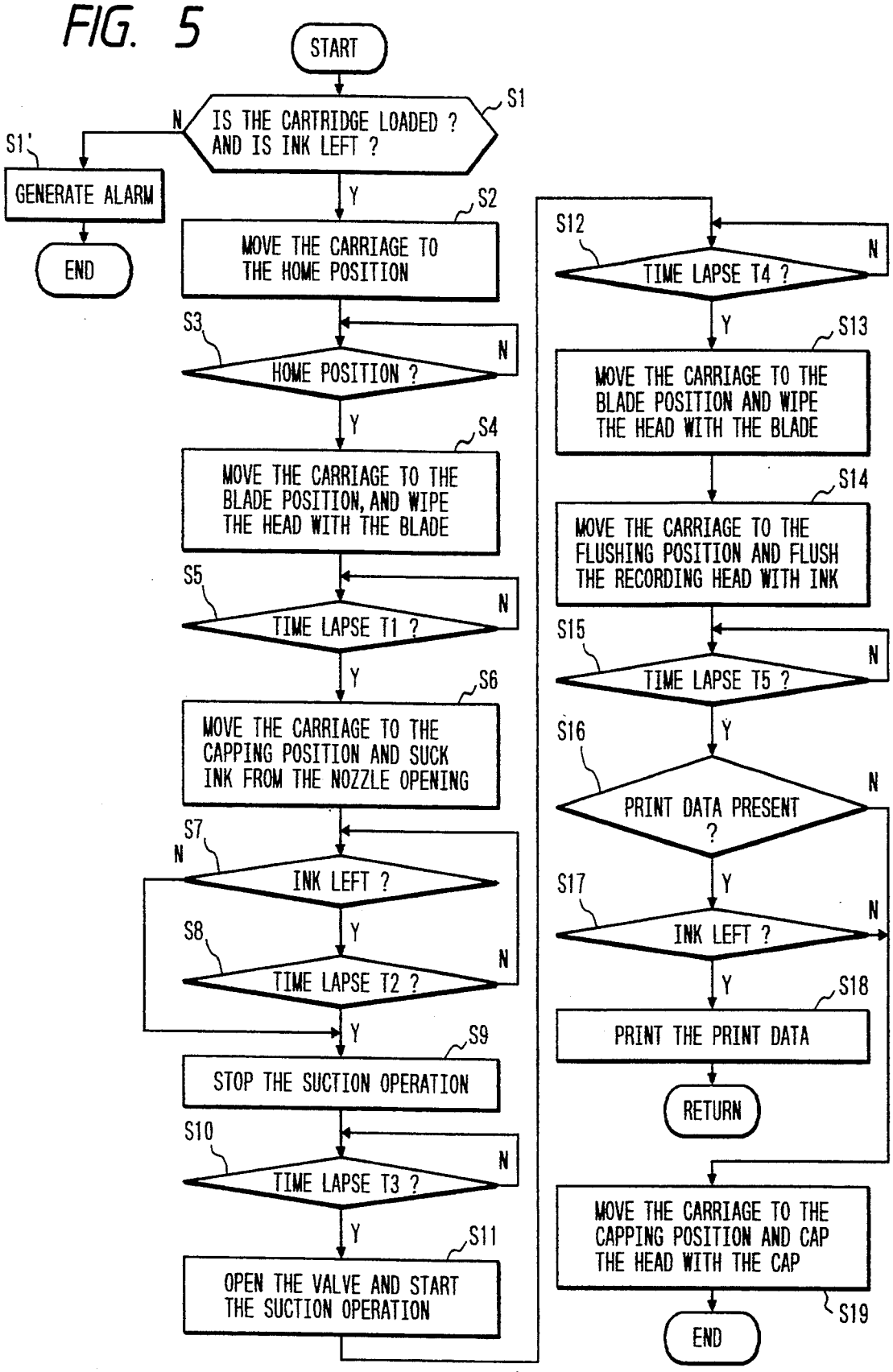
FIG. 5 is a flow chart showing the operation of the ink-expelling restoring device.

The operation of the ink-expelling restoring device thus constructed will be described with reference to FIG. 5 showing a flow chart.

When the printing operation has continued for a fixed period of time, the printing operation is brought to a stop at a proper place, for example, the place where the present line or a paragraph ends, and then the carriage 2 is moved out of the printing region.

During this process, the control unit checks whether or not an ink cartridge 4 has been loaded in response to a signal from the ink-cartridge detector 40, and checks whether or not ink is left in the cartridge in response to a signal from the ink residual-quantity detector 41 (step S1). When it is found that no ink cartridge 4 is loaded or one is loaded but the residual quantity of ink is considerably small, a message or an alarm to replace the ink cartridge 4 with a new one is issued (step S1'). By issuing such a cartridge-replacing message or alarm, the unfavorable circumstances whereby the ink is entirely consumed during the ink-expelling restoring operation, the recording head 1 and the ink supply path are empty, and consequently the ink-expelling restoring operation is interrupted are avoided.

When an ink cartridge 4 is loaded and ink remains, the carriage 2 is moved to the home position. In turn, the home position detector 5 produces a signal. At this time (I in FIG. 6), the motor 24 starts to rotate counterclockwise for a short time, for example, approximately 0.1 sec. As a result, the carriage 2 disengages from the arm 7 to allow the carriage 2 to move to the left side (as viewed in the drawing). The carriage 2 moves a preset distance from the home position until the nozzle face of the recording head 1 confronts the blade member 6. Then, the motor 24 turns clockwise (CW) to move the blade member 6 toward the recording head 1 and to bring the blade member 6 into contact with the front face of the recording head 1 (II in FIG. 6). Under this condition, the carriage 2 is further moved to the left, and the recording head 1 is wiped with the blade member 6 so that dust and ink residue are removed from the front end face of the recording head 1 (step S4). In the present embodiment, the wiping operation is carried out in the course of moving the carriage 2 from the home position toward the capping member 8. Alternatively, the recording head 1 can be moved to the left in a state where the blade member 6 has been retracted from the path of the recording head 1.

After the recording head 1 passes the blade member 6, the blade member 6 advances into the path of the recording head. Subsequently, when the recording head 1 is moved in the direction (right in the drawing) to return the recording head 1 to the home position, the recording head 1 is wiped with the blade member 6.

After a preset time T1, the wiping operation terminates. The carriage 2 moves until it reaches the capping position. The carriage 2 pushes the lever so that the capping member 8 is pressed against the front end face of the recording head 1, thereby to seal the recording head with the capping member (III in FIG. 6).

In this state, the motor 24 rotates in the CCW direction so that a negative pressure from the pump 25 is applied to the inside of the capping member 8 (step S6). Under this condition, ink is sucked from the opening of the nozzle of the recording head 1, thereby removing any dust left after the wiping operation. Further, bubbles remaining in the recording head 1 and the tube 3 connecting to the ink cartridge 4 are discharged into the capping member 8. The discharged ink and bubbles are extracted by the pump 25 and discharged into a used-ink tank (not shown). Also during the sucking process, the residual quantity of ink is monitored using a signal from the ink residual-quantity detector 41 (step S7).

After the sucking process has continued for a preset time T2 (step S8), the motor 24 is stopped and consequently the supply of the negative pressure to the capping member 8 is stopped. A preset time T3, e.g., two seconds, elapses in the state where the capping member 8 is pressed against the recording head 1, during which time the negative pressure within the capping member 8 drops to a certain level (step S10). At this time, the valve 21 is opened to communicate the capping member 8 with the outside atmosphere. Thereafter, the motor 24 turns again in the CCW direction to start the sucking action (step S11). As a result, used ink still left in the capping member 8 and excess ink absorbed by the ink absorbing member 12 are discharged outside the capping member 8 (step S11). In this air suction process, the inside of the capping member 8 is held at atmospheric pressure. Accordingly, no ink flows out of the recording head 1.

After a preset time T4, e.g., five seconds, elapses (step S12), the operation of the motor 24 is stopped and hence the air suction operation is stopped. Subsequently, the motor 24 turns in the CW direction, the rollers 28 of the pump 25 separate from the elastic tube 26.

Figure 6:
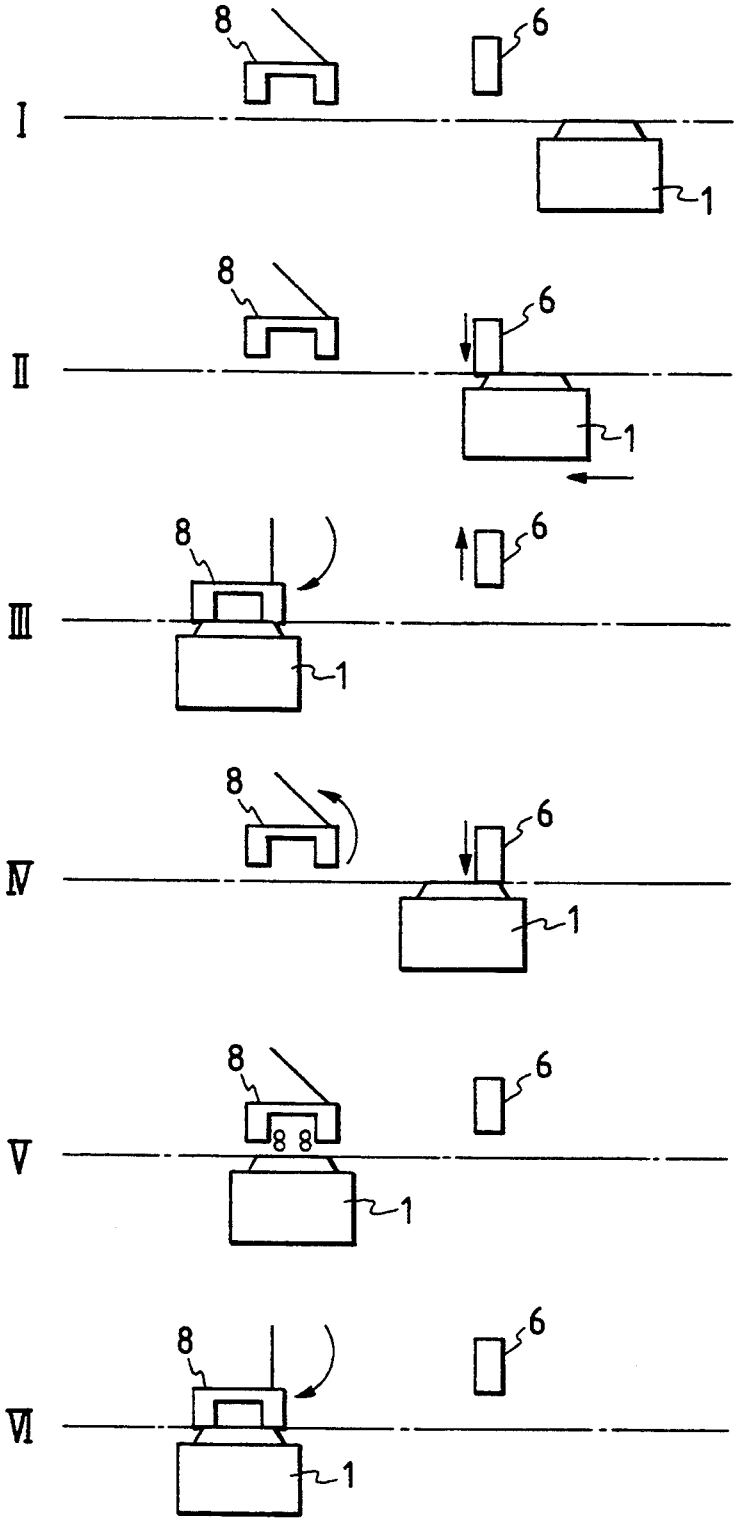
FIG. 6 is a set of explanatory diagrams used in explaining the operation of the ink-expelling restoring device.

Then, the carriage 2 is moved toward the home position detector 5, and the wiping operation is carried out as in the manner previously described (step S13, IV in FIG. 6). By the wiping operation, ink that has stuck to the front end face of the recording head in the ink-expelling restoring process is removed. As a result of this operation, the subsequent jetting of ink droplets is stable, and further ink will not stick to the nozzle face after a long rest of the recording head.

Subsequently, the carriage 2 is moved to the home position (on the right side in the drawing). When a gap large enough to allow the emission of a stream of ink droplets is formed between the recording head 1 and the capping member 8 (V in FIG. 6), the movement of the carriage 2 is stopped, and a print signal is applied to the recording head 1 to flush the recording head 1 (step S14). After a preset time T5 elapses (step S15), the output of the print signal is stopped to terminate the flushing operation. Here, the meniscus of the nozzle which has been destroyed by the wiping operation is restored to the normal state suitable for printing. At the same time, a prescribed quantity of ink, which has been discharged by the flushing operation, is absorbed by the ink absorbing member 12 in the capping member 8. The absorbed ink will be used for wetting the recording head when the head rests.

When the operation for restoring the ink-expelling capability is completed, if data to be printed is present (step S16) and a sufficient quantity of ink is left, the printing operation is executed (step S17). Subsequently, the printing operation continues while repeating the above sequence of operations.

At the completion of the ink-expelling restoring operation, if there is no data to be printed or a sufficient residual quantity of ink is present in the cartridge, the carriage 2 is moved again to the position of the capping member 8, and the recording head is capped (step S19, VI in FIG. 6). Due to the capping operation, the opening of the nozzle will be kept wet with the solvent of the ink contained in the ink absorbing member 12.

If, however, the residual quantity of ink in the ink cartridge 4 is determinate to be considerably small during the course of restoring the ink-expelling capability (step S7), the operation of the pump 25 is stopped for a shorter time than the preset time T2 (step S9). When a preset time T3 elapses and the pressure in the capping member 8 has become equal to atmospheric pressure (step S10), the valve 24 is opened to allow air suction to continue for a preset time T4, e.g., five seconds (step S12).

Subsequently, the carriage 2 is moved toward the home position detector 5, and the wiping operation is carried out in the manner previously described (step S13, IV in FIG. 6). As a result, ink that has stuck to the nozzle face during the ink-expelling restoring process is removed, thereby to clean the nozzle face.

The carriage 2 is moved to the home position (on the right side in the drawing). When a gap large enough to allow the emission of a stream of ink droplets is formed between the recording head 1 and the capping member 8 (V in FIG. 6), the movement of the carriage 2 is stopped, and a print signal is applied to the recording head 1 which in turn is flushed (step S14). After the preset time T5 elapses (step S15), the output of the print signal is stopped to terminate the flushing operation. A typical quantity of ink necessary for the flushing operation is approximately 0.03 cc, which is negligible when compared with the residual quantity of ink.

The meniscus of the nozzle which was destroyed by the wiping operation is restored to the normal state suitable for printing so that the ink within the nozzle opening will not be dried. In the instant example, an extremely small amount of ink is left in the ink cartridge 4 (steps S16 and S17). Accordingly, the carriage is moved to the capping position where the recording head L is capped with the capping member 8 (step S19). As a result, the recording head 1 is kept wet with the ink which has been absorbed in the ink absorbing member 12 through the flushing operation. The wet state of the recording head is maintained also when the recording head is at rest. When a state of "ink end" is detected, because the bottom area of the ink cartridge is relative large, if several cc of ink is left, data in an amount corresponding to the residual quantity of ink is allowed to be printed.

As can be understood from the foregoing description, the ink-expelling restoring operation is terminated before the residual ink in the ink cartridge 4 is completely discharged and in a state where ink is left in the ink supply path 3 and the recording head 1. Further, the recording head, whose nozzles have been restored to be operable for printing, stands ready for another recording operation. Accordingly, the recording head can be operated for printing by merely replacing the ink cartridge with a new one.

Figure 7:
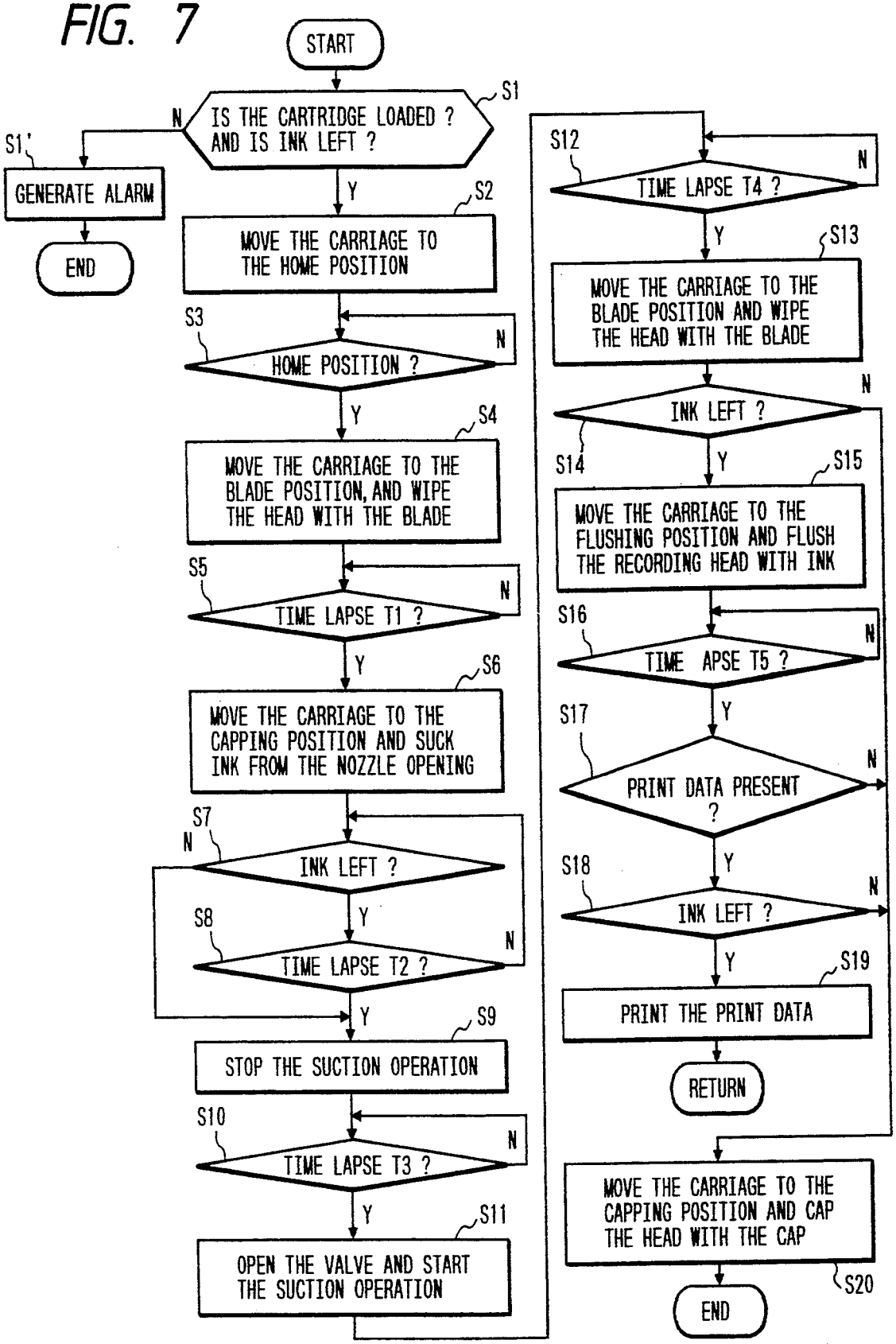
FIG. 7 is a flow chart showing the operation of the ink-expelling restoring device according to a second embodiment of the invention.

A second embodiment of the present will be described with reference to FIG. 7 showing a flow chart.

When the printing operation continues for a fixed period of time, the printing operation is brought to a stop at a proper place, for example, the place where a page or paragraph ends, and the carriage 2 is moved out of the printing region.

During this process, the control unit checks whether or not an ink cartridge 4 has been loaded using a signal from the ink-cartridge detector 40, and checks whether or not ink is left in the cartridge using a signal from the ink residual-quantity detector 41 (step S1). When the check results show that no ink cartridge 4 is not loaded or one is loaded but the residual quantity of ink is considerably small, a message or an alarm to replace the ink cartridge 4 is issued (step S1').

When an ink cartridge 4 is loaded and ink is left, the carriage 2 is moved to the home position. In turn, the home position detector 5 produces a signal. The carriage 2 moves a prescribed distance from the position where the home position detector 5 produces a signal (I in FIG. 6) and the nozzle face of the recording head 1 confronts with the blade member 6. Then, the blade mender 6 is moved toward the recording head 1 and to bring the blade member 6 into contact with the front face of the recording head 1 (II in FIG. 6). Under this condition, the carriage 2 is further moved to the left, and the recording head 1 is wiped with the blade member 6 so that dust and ink residue are removed from the front end face of the recording head 1 (step S4).

After a preset time T1, the wiping operation terminates. The carriage 2 is moved until it reaches the capping position. The capping member 8 is then pressed against the front end face of the recording head 1, thereby to seal the recording head with the capping member 8 (III in FIG. 6).

In this state, a negative pressure from the pump 25 is applied to the inside of the capping member 8 (step S6). Under this condition, ink is sucked from the opening of the nozzle of the recording head 1, thereby removing any dust left after the wiping operation. Further, bubbles remaining in the recording head 1 and the tube 3 connecting to the ink cartridge 4 are discharged into the capping member 8. Thus, the discharged ink and bubbles are extracted by the pump 25 and discharged outside the system. During the sucking process, a residual quantity of ink is monitored using a signal from the ink residual-quantity detector 41 (step S7).

After the suction process has been continued for a predetermined time T2 (step S8), the pump 25 is stopped, thereby stopping the supply of the negative pressure to the capping member 8.

A preset time T3, e.g., two seconds, elapses in the state where the capping member 8 is pressed against the recording head 1, during which time the negative pressure within the capping member 8 drops (Step S10). At this time, the valve 21 is opened to communicate the capping member 8 with the outside atmosphere. Thereafter, the pump 25 is operated again to start the sucking operation (step S11). As a result, used ink still left in the capping member 8 and excess ink absorbed by the ink absorbing member 12 are sucked and discharged outside the capping member 8 (step S11).

After a preset time T4, e.g., five seconds, has elapsed (step S12), the operation of the pump 25 is stopped and hence the air suction operation is stopped.

Then, the carriage 2 is moved toward the home position detector 5, and the wiping operation is carried out as in the manner previously described (step S13, IV in FIG. 6). As a result of the wiping operation, ink that has stuck to the front end face of the recording head in the ink-expelling restoring process is removed.

After the control unit confirms that ink is still left in the ink cartridge 4 in response to a signal from the ink residual-quantity detector 41 (step S14), the carriage 2 is moved to the home position (on the right side in the drawing). When a gap large enough to allow the emission of a stream of ink droplets is formed between the recording head 1 and the capping member 8 (V in FIG. 6), a print signal is applied to the recording head 1, which in response is flushed with ink (step S15). After a preset time T5 elapses (step S16), the output of the print signal is stopped to terminate the flushing operation. The meniscus of the nozzle which has been destroyed by the wiping operation is restored to the normal state suitable for the printing. At the same time, a prescribed quantity of ink discharged during the flushing operation is absorbed by the ink absorbing member 12 in the capping member 8. The absorbed ink is used for wetting the recording head when the head rests.

When the operation for restoring the ink-expelling capability is completed, if data to be printed is present (step S17) and a sufficient quantity of ink is left, the printing operation is executed (step S19). Subsequently, the printing operation continues while repeating the above sequence of operations.

At the completion of the ink-expelling restoring operation, if there is no data to be printed or a residual quantity of ink is present in the cartridge, the carriage 2 is moved again to the position of the capping member 8, and the recording head is capped (step S20, VI in FIG. 6). With the capping, the opening of the nozzle will be kept wet with the solvent of the ink contained in the ink absorbing member 12, If the residual quantity of ink in the ink cartridge 4 is considerably small during the course of restoring the ink-expelling capability (step, S7), the operation of the pump 25 is stopped for a shorter time than the preset time T2 (step S9). Therefore, useless consumption of ink in a state where the recording head fails to print, even if it is subjected to the ink-expelling restoring operation, is eliminated. The ink-expelling restoring operation is terminated before the residual ink in the ink cartridge 4 is completely discharged. In a state where such a quantity of ink as to prevent the ink in the recording head 1 from being dried is left in the ink supply path 3, the recording head stands ready for replacement of the ink cartridge.

The capping of the recording head 1 with the capping member 8 continues until a preset time T3 elapses after the pump 25 stops (step S10) and the negative pressure within the capping member 8 has dropped sufficiently. Subsequently, the valve 21 is opened and the pump 25 is operated to execute air suction (step S11). Consequently, the ink left in the capping member 8 is discharged to the outside.

After removal of the capping member 8, the recording head 1 is moved to the position of the blade member 6 where it is wiped (step S13). In this example, the quantity of ink in the ink cartridge 4 is considerably small (step S14). The capping member 8 is brought into contact with the recording head 1, without carrying out a flushing operation (step S20). Accordingly, even in a case where the quantity of ink is considerably small, the recording head can stand ready for the next printing operation is a state where ink is left in the ink supply path and the recording head, and the ink is removed from the nozzle front end face by the ink suction operation.

The peristaltic pump, which is used as negative pressure generator in the above-described embodiment, may be replaced with another type of pump such as piston pump.

While in the embodiment described above, the ink cartridge is mounted on the base member, it and the recording head as well may be mounted on the carriage.

As described above, the ink-expelling restoring device for an ink jet printer of the invention includes a capping member for capping the front face of a recording head, an ink-residual quantity detector for detecting the residual quantity of ink in an ink container, a wiping device for physically wiping the front face of the recording head, and a control unit which operates to restore the ink-expelling capability by a sequence of a wiping operation, a ink-suction operation, and a flushing operation, which checks the residual quantity of ink with the use of the ink-residual quantity detector during the operation of restoring the ink-expelling capability, and stops the ink suction operation when the residual-quantity of ink is smaller than a preset quantity of ink, while at the same time capping the recording head with the capping member. In the ink-expelling restoring device thus constructed, when the residual quantity of ink is considerably small during the ink-expelling restoring process, the ink-expelling restoring device prevents the useless consumption of ink. Further, in the ink-expelling restoring device, the ink-expelling restoring process automatically proceeds through a prescribed sequence of restoring operations including the final operation of wiping. Following this, the ink-expelling restoring device is in a standby state. Accordingly, the recording head waits for the next printing operation in a state where the head is kept wet and no air flows into the ink supply path.

What is claimed is:

1. An ink-expelling restoring device for an ink jet printer comprising:

a capping member capping a front face of a recording head;

ink-residual quantity detector detecting a residual quantity of ink in an ink container supplying ink to said recording head;

a wiping device wiping said front face of said recording head;

a pump sucking excess ink within said capping member when said recording head is capped, by said capping member;

a flushing unit driving said recording head for idle discharge when said recording head is at a flushing position; and a control device restoring the ink-expelling capability of said recording head by controlling operations of said capping member, said ink-residual quantity detector, said wiping device, said pump, and said flushing unit by a sequence of a wiping operation by said wiping device, and ink-suction operation by said pump, and a flushing operation by said flushing unit, said control device checking a residual quantity of ink with said ink-residual quantity detector while restoring said ink-expelling capability, and stopping said ink suction operation by said pump when the residual quantity of ink is smaller than a preset quantity of ink, said control device controlling said capping member to cap said recording head with said capping member after said flushing and wiping operations.

2. The ink-expelling restoring device of claim 1, wherein said control device performs said operation of capping said recording head with said capping member immediately after said flushing and wiping operations.

3. A method for restoring ink-expelling in an ink jet printer, comprising the steps of:

wiping a front face of said recording head;

sucking ink from nozzle openings of said recording head;

detecting an amount of residual ink in an ink container supplying ink to said recording head;

if said amount of residual ink is greater than a predetermined amount, continuing said step of sucking ink from nozzle openings of said recording head for a predetermined period of time;

if said amount of residual ink is less than said predetermined amount, immediately discontinuing said step of sucking ink from nozzle openings of said recording head; and flushing said recording head with ink.

4. The method for restoring ink-expelling of claim 3, further comprising the steps of:

detecting whether or not printing data is present for driving said recording head;

if no printing data is present, capping said recording head; and if printing data is present, driving said recording head with said printing data.

5. The method for restoring ink-expelling of claim 3, wherein said step of sucking ink from nozzle opening of said recording head comprises the steps of:

moving said recording head to a capping position;

capping said recording head with a capping member; and applying a negative pressure within said capping member.

6. The method for restoring ink-expelling of claim 5, further comprising the steps of:

releasing said capping member from said recording head; and discharging excess ink from said capping member.

7. The method for restoring ink-expelling of claim 6, further comprising, subsequent to said step of discharging excess ink from said capping member and prior to said step of flushing said recording head with ink, a second step of wiping said face of said recording head.

8. The method for restoring ink-expelling of claim 7, further comprising, subsequent to said second step of wiping said face of said recording head and prior to said step of flushing said recording head with ink, the steps of:

detecting an amount of residual ink in said ink container supplying ink to said recording head; and if said amount of residual ink is less than a second predetermined amount, capping said recording head and omitting said step of flushing said recording head with ink.

9. An ink-expelling restoring device for an ink jet printer comprising:

a capping member capping a front face of a recording head;

ink-residual quantity detector detecting a residual quantity of ink in an ink container supplying ink to said recording head;

a wiping device wiping said front face of said recording head;

a pump sucking excess ink within said capping member when said recording head is capped by said capping member;

a flushing unit driving said recording head for idle discharge when said recording head is at flushing position; and a control device restoring the ink-expelling capability of said recording head by controlling operations of said capping member, said ink-residual quantity detector, said wiping device, said pump and said flushing unit by a sequence of a wiping operation by said wiping device, an ink-suction operation by said pump, and a flushing operation by said flushing unit, said control device checking a residual quantity of ink with said ink-residual quantity detector while restoring said ink-expelling capability, stopping said ink suction operation by said pump when the residual quantity of ink is smaller than a preset quantity of ink, and controlling said capping member to cap said recording head with said capping member immediately after stopping said ink suction operation.

* * * * *